US006053326A

United States Patent [19]

Ford

[11] Patent Number: 6,053,326

[45] Date of Patent: Apr. 25, 2000

[54] THEFT DETERRENT PACKAGE FOR WALLETS AND BILLFOLDS

[75] Inventor: Allan L. Ford, Melrose Park, Pa.

[73] Assignee: Reborn Products Co., Inc., Bensalem, Pa.

[21] Appl. No.: 09/252,530

[22] Filed: Feb. 17, 1999

[51] Int. Cl.[7] ..... B65D 73/00; A44B 21/00

[52] U.S. Cl. ..... 206/779; 206/478; 206/493; 53/139.4; 53/416

[58] Field of Search ..... 206/278, 279, 206/292, 293, 294, 296, 460, 477, 478, 480, 481, 779, 807, 459.5, 493, 495; 53/478, 416, 139.4, 138.1

[56] References Cited

U.S. PATENT DOCUMENTS

| | | | |
|---|---|---|---|
| 1,553,827 | 9/1925 | Lee | 206/732 |
| 3,036,802 | 5/1962 | Kitchell | 206/813 |
| 5,772,039 | 6/1998 | Orr et al. . | |

*Primary Examiner*—M. D. Patterson
*Assistant Examiner*—Luan K. Bui
*Attorney, Agent, or Firm*—Caesar, Rivise, Bernstein, Cohen & Pokotilow, Ltd.

[57] ABSTRACT

A packaging system and method of packaging for a foldable wallet or billfold to enable the wallet or billfold to be opened and examined while deterring the wallet or billfold from being removed from the packaging system. The wallet or billfold has a fold line about which the wallet or billfold is arranged to be folded shut, and an opening in a portion of the wallet or billfold contiguous with the fold line. The packaging system comprising a box and a strip, e.g., band, member. The strip member is an elongated flexible member formed of a tear resistant material, e.g., a flat strip of plastic. The box has a base portion with peripheral side walls forming a hollow interior into which the wallet or billfold is disposed. The strip member is arranged to be extended through the opening in the wallet and overlying the fold line while being permanently secured to at least one of said sidewalls of the base portion. Thus, the wallet is not susceptible to removal without destroying the package. A lid is provided to cover the box. A flanged insert member may also be provided in the interior of the box to serve as a means for carrying visible indicia, e.g., the model designation of the wallet or billfold, a trademark, pricing information, etc.

9 Claims, 3 Drawing Sheets

THEFT DETERRENT PACKAGE FOR WALLETS AND BILLFOLDS

BACKGROUND OF THE INVENTION

This invention relates generally to a packaging, and more particularly to a box used for displaying wallets and billfolds.

In U.S. Pat. No. 5,772,039 (Orr et al.) there is disclosed a theft-deterrent display packaging system having particular utility for displaying a foldable wallet in a manner to enable a shopper to readily examine the wallet, e.g., open the wallet, without being able to remove the wallet from the packaging and without destroying the packaging, thus deterring theft of the wallet. That packaging system basically comprises a conventional box in which a "box insert" is adhesively secured. The box insert includes an opening through which a plastic band, e.g., either a filament or flat loop, may be extended. The plastic band is arranged to encircle or overlie the center of the wallet at the fold line so that a portion of the band extends over the middle of the wallet at the fold line, while a portion of the band extends through the opening in the insert. The ends of the band include adhesive portions to affix the band to the box insert. The box insert is itself adhesively secured to the interior of the box, thereby precluding the removal of the box insert and the band from the box.

While the Orr et al. patent appears generally suitable for its intended purposes, it never the less leaves much to be desired from the standpoint of simplicity, e.g., the use of the box insert increases the component count of the packaging system and necessitates the securement, adhesive fixation, of the insert within the interior of the box. A more significant drawback of the system of the Orr et al. patent is its effectiveness in deterring theft. In this regard, since the band of the Orr et al. construction merely extends over the center fold line of the wallet, it is possible to remove the wallet by pulling it out from under the band. Moreover, if the adhesive securement of the insert to the box is not very strong it is possible to tear the insert with the wallet from the interior of the box.

Accordingly a need exists for a packing system which is simpler in construction than that of the Orr et al. patent and which provides a greater measure of theft deterrence.

OBJECTS OF THE INVENTION

It is accordingly an object of this invention to provide a package for wallets or billfolds which addresses those needs.

It is another object of this invention to provide a package which prevent extraction of a wallet or billfold held therein without destroying the package.

It is another object of this invention to provide a package in the form of a box and a band secured thereto for positive engagement with a foldable wallet or billfold to prevent the wallet or billfold from being removed from under the band.

It is yet another object of this invention to provide a package in the form of a box and a band secured thereto for holding a foldable wallet or billfold having an opening contiguous with the fold line, whereupon the band prevents extraction of the wallet from the box without destroying the box.

SUMMARY OF THE INVENTION

These and other objects of this invention are accomplished by providing a packaging system for a wallet or billfold and a method of packaging a wallet or billfold to enable its ready inspection or examination, while deterring theft of the wallet/billfold. The wallet/billfold for which the packaging system and method is of particular utility is any conventional foldable type having a fold line about which the wallet is arranged to be folded shut. Preferably the wallet/billfold includes an opening in a portion of the it contiguous with its fold line.

The packaging system basically comprises a box and a strip member. The strip member is an elongated flexible member formed of a tear-resistant material, e.g., a flat band of plastic. The box has a base portion with peripheral side walls forming a hollow interior into which the wallet/billfold is disposed. The strip is arranged to be extended through the opening in the wallet/billfold and to be permanently fixed secured to at least one of the sidewalls of the base portion.

The method for packaging the wallet/billfold entails extending the strip member through the opening in the wallet/billfold with a portion of the strip member overlying the fold line, disposing the wallet/billfold within the interior of the base portion, and permanently fixedly securing the strip member to at least one of the sidewalls of the base portion.

DESCRIPTION OF THE DRAWINGS

Other objects and many of the attendant advantages of this invention will become readily appreciated as the same becomes better understood by reference to the following detailed description, when considered in connection with the accompanying drawing, wherein.

DETAILED DESCRIPTION OF THE PREFERRED EMBODIMENT

Figure 1:
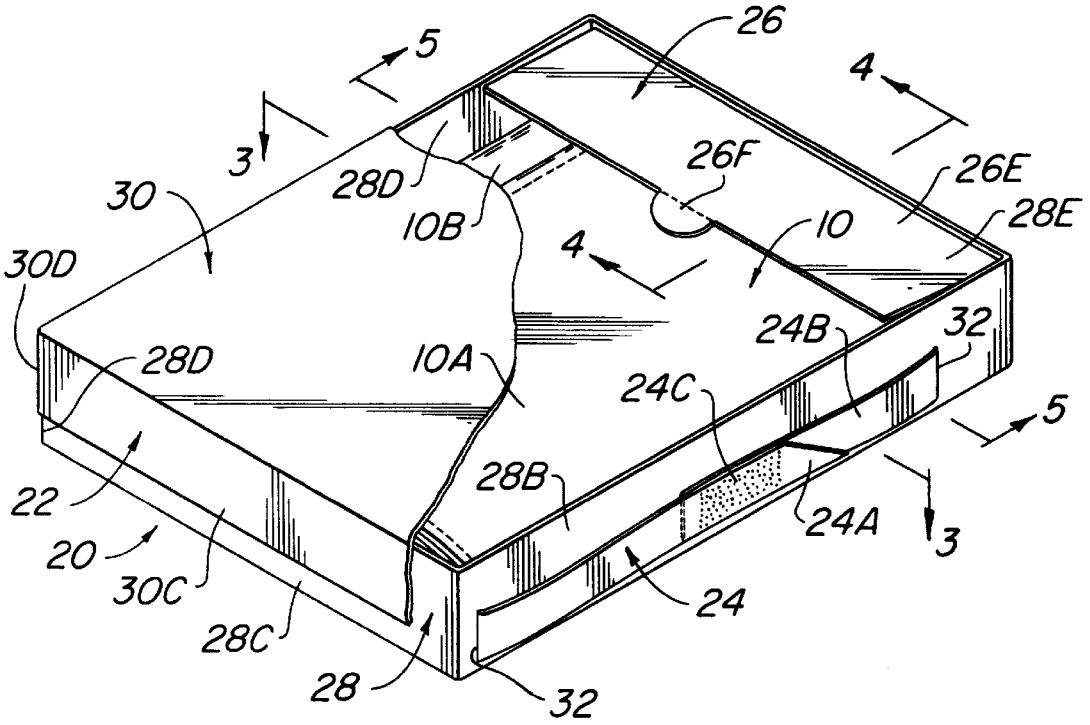
FIG. 1 is an isometric view of a theft-deterrent box holding a conventional, foldable wallet/billfold therein to enable opening (unfolding) of the wallet/billfold for inspection, while precluding removal of the wallet/billfold from the box.

Referring now in greater detail to the various figures of the drawing, wherein like reference characters refer to like parts, a package embodying the present invention is generally shown at 20 in FIG. 1 for holding a foldable wallet or billfold 10 therein. Before discussing the details of the package 20, a brief discussion of the types of wallets or billfolds 10 which may be housed for display within the package 20 is in order.

As is known numerous wallet or billfold constructions exist and many are presently in use. For example, some prior art wallets or billfolds typically include a single, a divided single, or a double paper money or bill compartment extending the length of the unfolded, generally rectangular wallet/billfold. Compartments for credit cards, identification cards and the like are often placed in front of the paper money compartment and may be designed as slots or pockets for sliding the cards into the wallet/billfold. The card compartments may be aligned such that one short side, or one long side, of each card is exposed in a staggered arrangement. Prior art wallets have been constructed from a multitude of relatively strong and tear-resistant materials, e.g., leather, plastic, fabric, etc., Many include linings that are sewn into the wallet/billfold.

Many types of billfolds or wallets capable of holding paper money in a foldable compartment also include an enclosed slit or other opening in the material of the wallet forming the bill compartment, and which slit is contiguous with the fold line at the bottom of the bill compartment. It is this type of wallet or billfold for which the subject packaging system has its best utility for reasons to be apparent from the discussion to follow. However, it must be noted that the packaging of the subject invention can be used for holding any other type of foldable wallet or billfold, as well. Thus, the inclusion of an enclosed slit or other opening in a portion of the material making up the wallet or billfold is not mandatory for use with this invention.

Figure 5:
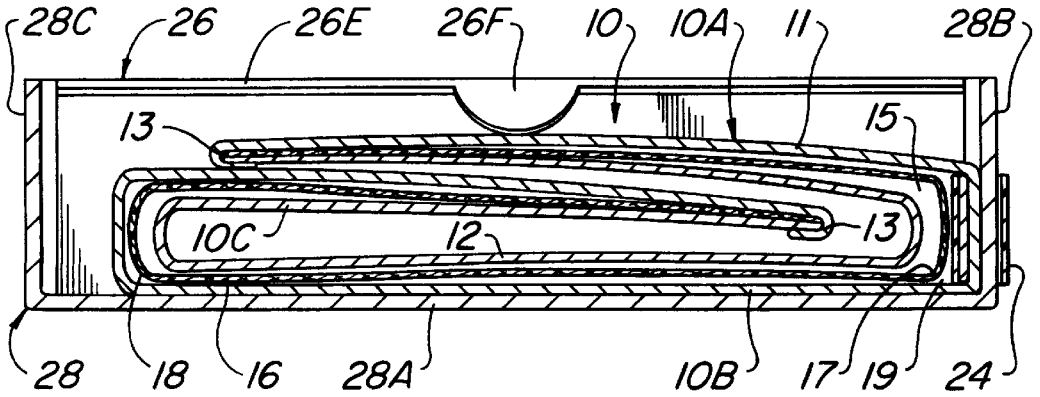
FIG. 5 is an enlarged sectional view taken along line 5—5 of FIG. 1.
Figure 2:
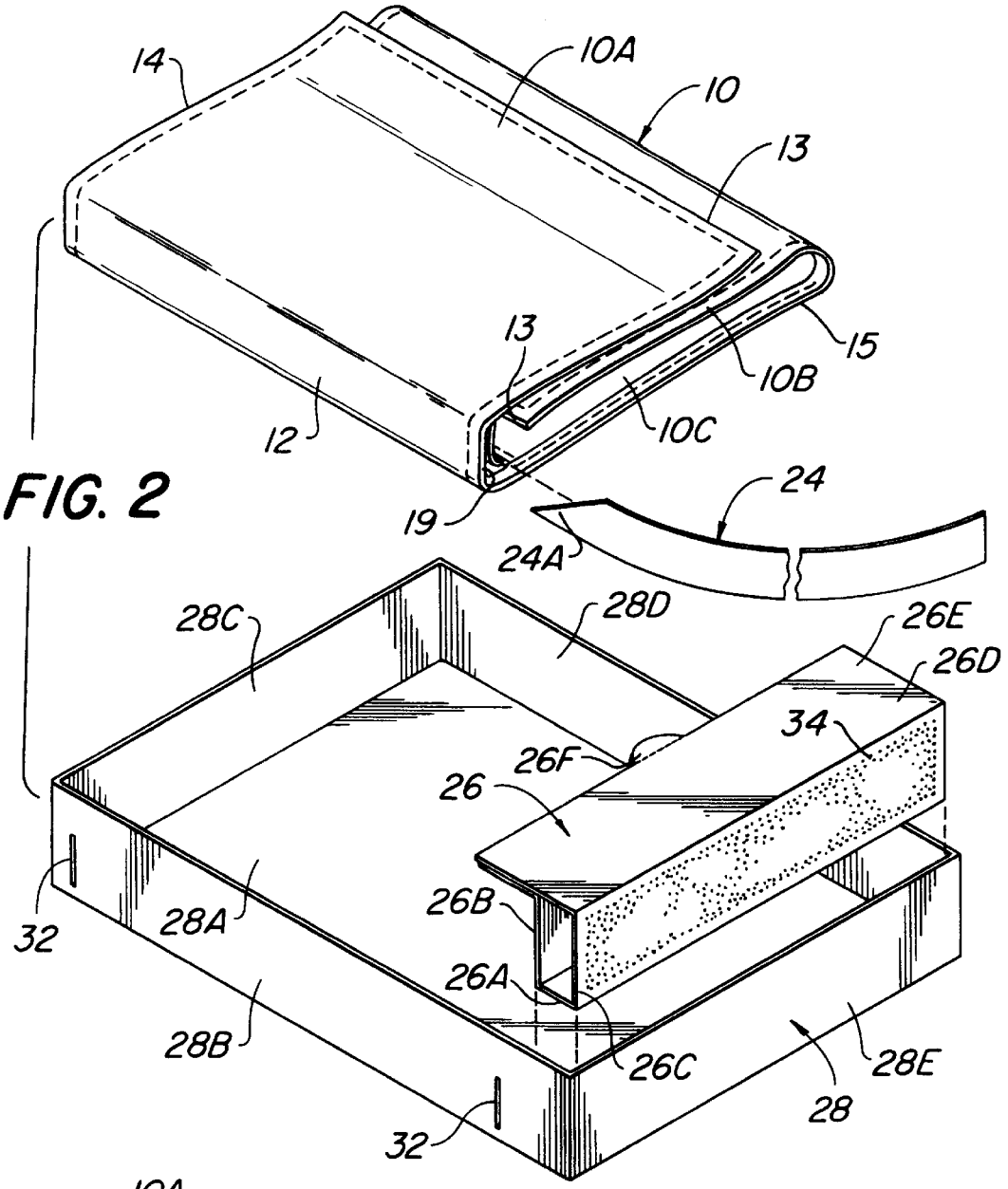
FIG. 2 is an exploded isometric view of the box and the wallet/billfold shown in FIG. 1.
Figure 4:
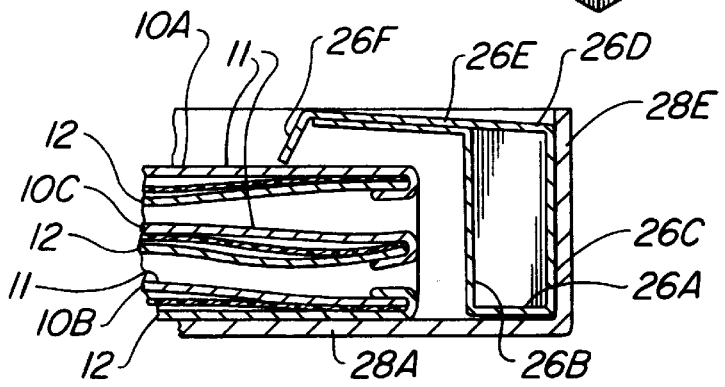
FIG. 4 is an enlarged sectional view taken along line 4—4 of FIG. 1.
Figure 3:
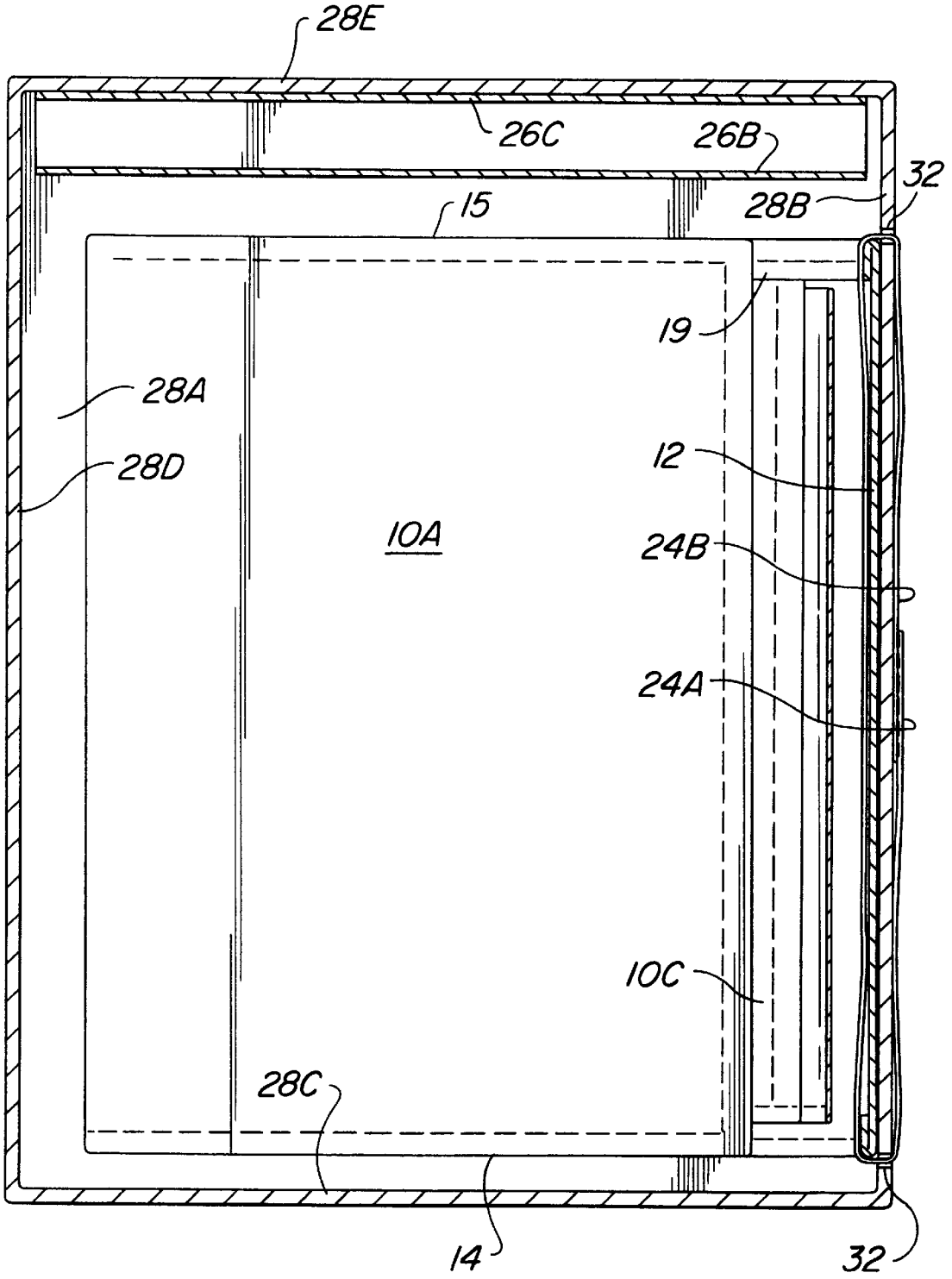
FIG. 3 is an enlarged sectional view taken along line 3—3 of FIG. 1.

As can be seen in FIGS. 2, 3 and 5 the exemplary wallet/billfold 10 is of a tri-fold design. That is, it includes a rectangular outer wall panel 11, a rectangular inner wall panel 12 which is sewn or otherwise attached to the outer wall panel along its two side edges 13 and along its bottom edge 14 to form a bill-receiving compartment 15. A liner panel 16 coextensive with the inner and outer panels may be interposed therebetween and secured in place by the means as used to secure the inner and outer panels together, e.g., stitches. The wallet/billfold 10, being of a tri-fold type, is arranged to be folded into three overlapping sections 10A, 10B and 10C, along respective fold lines 17 and 18. In particular, the fold line 17 is located between the foldable sections 10A and 10B to enable section 10A to overlie section 10B, while the fold line 18 is located between the foldable sections 10B and 10C to enable the section 10C to overlie section 10B and be under section 10A. A slit or opening 19, e.g., an unsewn portion, (FIGS. 2 and 3) is provided at the interface of the inner wall panel and outer wall panel along the bottom edge 15 and contiguous with the fold line 17.

It should be pointed out at this juncture that the wallet/billfold 10 may be of a bifold type instead of the tri-fold shown. In such a case there will only be two sections 10A and 10B and a single fold line 17 therebetween, with the slit or opening 19 being contiguous with that fold line.

Referring now to FIGS. 1 and 2 the package 20 can be seen to basically comprise a box 22, a securement strap or band 24, and an insert 26. The box 22 is of a generally conventional construction in that it includes a generally rectangular base portion 28 and a cover or lid 30. The base portion 28 has a generally rectangular bottom wall 28A and four upstanding sidewalls 28B, 28C, 28D, and 28E. The side of the bottom wall and the height of the side walls are selected so that the wallet/billfold 10 in its folded condition, like that shown in FIGS. 2, 3 and 5 can be accommodated therein with some space for the insert 26. The cover or lid 30 is of a corresponding size to just fit over the base portion. Thus, it has a generally rectangular top wall 30A and four downwardly extending sidewalls, only two of which 30B and 30C, are shown. When the cover is in place on the base the downwardly extending sidewalls of the cover extend partially over the four upstanding sidewalls 28B, 28C, 28D, and 28E, of the base portion.

The side wall 28B of the base portion 28 includes a pair of slits or apertures 32 extending therethrough. One of the slits 32 is located closely adjacent the point at which the side wall 28B merges with side wall 28C, while the other the slits 32 is located closely adjacent the point at which the side wall 28B merges with side wall 28E, as best seen in FIG. 3.

The base portion and the cover or lid can be formed of any suitable strong and somewhat tear or abuse resistant material, e.g., cardboard, plastic, etc.

The band 24 basically comprises an elongated thin strip or web of a strong, tear resistant, flexible material, such as polyvinyl chloride or any other suitable plastic, leather, etc., which is formed into a loop and secured to form the band, as will be described hereinafter. The band 24 serves as the means to secure the wallet/billfold in the hollow interior of the base portion of the box 22 so that the wallet/billfold can be readily inspected, e.g., its sections unfolded from one another, while deterring its removal without tearing or otherwise destroying the base portion of the box. To form the band 24 the "leading end" 24A of the strip 24 is extended through the slit 32 in the side wall 28A of the base portion of the box closest to the side wall 28E, then through the slit 19 in the wallet/billfold 10, which is located within or adjacent the hollow interior of the base portion of the box, and from there along fold line 18 until the lead end 24A of the strip exits out the top edge of the wallet/billfold. From there the leading end 24A of the strip is extended through the other slit 32, i.e., the slit closest to the side wall 28C, to the outside of the base portion of the box along the outside of the side wall 28B until it is brought into engagement with the "trailing end" 24B of the strip. Either end 24A or end 24B may overlap the other, as desired. In any case the overlapping end portions of the strip are then permanently secured to each other by any suitable means, e.g., an adhesive, a heat or ultrasonic weld, etc., at their interface 24C. This completes the band. Alternatively, the leading end 24A of the strip 24 and the trailing end 24B of the strip may each be secured to the side wall 28B of the base portion of the box 22 by any suitable means, e.g., an adhesive, a fastener, etc.

With the band secured in place, as just described, it will be apparent that when the lid of the box is removed a potential purchaser of the wallet/billfold may view the folded wallet/billfold within the interior of the base portion of the box. If that person wishes to examine the interior of the wallet/billfold by unfolding its sections, that can be readily accomplished, without interference by the band 24. However, removal of the wallet/billfold will be precluded from the base portion of the box by the band. In this regard, since the band extends through the opening or slit 19 in the wallet/billfold, which slit is surrounded by the material making up the wallet/billfold, a person cannot slip the wallet/billfold out from under the band, as is the case with the prior art. Thus, the only way to remove the wallet/billfold is to tear or otherwise destroy the box and/or band to free the wallet/billfold.

In the interest of aesthetics the band 24 may be transparent so that it is not readily visible, notwithstanding the fact that it extends alongside outside of the side wall 28B. Alternatively, the band may be colored or provided with some aesthetically pleasing indicia or surface features to enhance the appearance of the package.

It should be noted at this juncture that the band need not extend outside the box in order to securely hold the wallet/billfold in place. In fact, it is contemplated that the band 24 need not be in the form of a loop extending through slits 32. In such an arrangement no slits 32 are utilized and the leading end 24A of the strip 24 is permanently secured by any suitable means to the inside of the side wall 28B adjacent the side wall 28C, while the trailing end 24B of the strip is permanently secured by any suitable means to the inside of the side wall 28B adjacent the side wall 28E. In this latter arrangement the band 24 will not be visible from the exterior of the box.

If it is desired to provide some indicia, e.g., trademarks, logos, product information, pricing information etc., so that it is readily visible when the lid of the box 22 is removed, the heretofore identified insert 26 may be provided. Thus, it must be appreciated that the insert is merely optional. The insert 26 may take any desired shape and can be formed of any suitable material, e.g., cardboard, plastic, etc. Moreover, the insert may be removable or permanently secured within the hollow interior of the base portion of the box adjacent the wallet/billfold. In the embodiment shown it is secured via an adhesive 34 to the interior of the side wall 28E In the embodiment shown the insert 26 is in the form of a hollow rectangular member having a base wall 26A, a pair of side walls 26B and 26C, and a top wall 26D. The top wall 26D is wider than the width of the base wall 26A so that it forms an overhanging flange 26E. The top end of the side wall 26B also includes a flanged portion which is located under the flange 26E and may be adhesively secured thereto. The top surface of the top wall 26D and contiguous flange 26E is arranged to bear some indicia (not shown) of the type described above thereon. A central semi-circular tab 26F projects outward and downward from the edge of the flange portion 26E. The tab and the flange overlie a portion of the wallet, with the tab engaging the wallet.

Without further elaboration, the foregoing will so fully illustrate my invention that others may, by applying current or future knowledge, readily adapt the same for use under various conditions of service.

I claim:

1. In combination a package and a foldable wallet, said wallet or billfold having a fold line about which said wallet or billfold is arranged to be folded shut, and an opening in a portion of said wallet or billfold contiguous with said fold line, said package comprising a box and a strip member, said strip member being an elongated flexible member formed of a tear resistant material, said box having a base portion with peripheral side walls forming a hollow interior into which said wallet or billfold is disposed, said strip member being arranged to be extended through said opening in said wallet or billfold and being permanently fixed secured to at least one of said sidewalls of said base portion.

2. The combination of claim 1 wherein said strip member is directly secured to one of said sidewalls.

3. The combination of claim 1 wherein at least one of said sidewalls has at least one aperture therein through which said strip member extends.

4. The combination of claim 1 additionally comprising a lid for said box.

5. The combination of claim 1 wherein said strip member comprises a loop having a pair of ends.

6. A method of packaging a wallet or billfold in a package to enable the wallet or billfold to be readily examined but to prevent the removal therefrom without destruction of the package, said wallet or billfold having a fold line about which said wallet or billfold is arranged to be folded shut, and an opening in a portion of said wallet or billfold contiguous with said fold line, said package comprising a box and a strip member, said box having a base portion with peripheral side walls forming a hollow interior, said method comprising the steps of:

(A) extending said strip member through said opening in said wallet or billfold with a portion of said strip member overlying said fold line;

(B) disposing said wallet or billfold within the interior of said base portion; and (C) permanently fixedly securing said strip member to at least one of said sidewalls of said base portion.

7. The method of claim 6 wherein said strip member is directly secured to one of said sidewalls.

8. The method of claim 6 wherein at least one of said sidewalls has at least one aperture and wherein said method comprises extending a portion of said strip member through said at least one aperture.

9. The method of claim 6 additionally comprises forming said strip member into loop.

* * * * *